US005671724A

United States Patent [19]

Priebe

[11] Patent Number: 5,671,724

[45] Date of Patent: Sep. 30, 1997

[54] BOW SIGHT

[76] Inventor: Donald F. Priebe, P.O. Box 482, Pinckney, Mich. 48169

[21] Appl. No.: 352,499

[22] Filed: Dec. 9, 1994

[51] Int. Cl.[6] ..... F41G 1/467

[52] U.S. Cl. ..... 124/87; 33/265

[58] Field of Search ..... 124/86, 87, 88; 33/265

[56] References Cited

U.S. PATENT DOCUMENTS

| | | | |
|---|---|---|---|
| 4,162,579 | 7/1979 | James | 33/265 |
| 4,170,071 | 10/1979 | Mann et al. | 33/265 |
| 4,215,484 | 8/1980 | Lauffenburger | 33/265 |
| 4,417,403 | 11/1983 | Strange | 33/265 |
| 4,473,959 | 10/1984 | Saltzman | 33/265 |
| 4,494,313 | 1/1985 | Scott | 33/265 |
| 4,570,352 | 2/1986 | Leal | 33/265 |
| 4,662,347 | 5/1987 | Carlton | 124/87 |
| 4,669,194 | 6/1987 | Amacker | 33/265 |
| 4,685,217 | 8/1987 | Shader | 33/267 |
| 4,915,088 | 4/1990 | Powers | 124/87 |
| 4,977,677 | 12/1990 | Troescher | 33/265 |
| 5,040,301 | 8/1991 | Forbis | 33/265 |
| 5,048,193 | 9/1991 | Hacquet | 33/265 |
| 5,367,780 | 11/1994 | Savage | 33/265 |

*Primary Examiner*—John A. Ricci
*Attorney, Agent, or Firm*—Harness, Dickey & Pierce, P.L.C.

[57] ABSTRACT

A rear sight mounted to a bow for use in conjunction with a front sight. The rear sight includes a bracket mounted to the bow and having an extension portion terminating in a mounting plate. The extension extends rearward of the bow frame and locates the mounting plate in a position between the frame and the bow string. A sight ring is attached to the mounting plate and extends generally laterally away from the plate. The sight ring defines a sighting window with an aperture through it and tapered cross hairs extend radially inward from the sight ring. The length of the cross hairs is such that they terminate at ends which cooperate to define an open area generally centrally within the aperture. The open area is alignable with the ends of the front sight pins and the target to provide for an accurate shot of an arrow from the bow.

9 Claims, 2 Drawing Sheets

BOW SIGHT

BACKGROUND AND SUMMARY OF THE INVENTION

The present invention generally relates to the field of archery equipment. More particularly, this invention is related to a bow mounted sighting mechanism which can be used to accurately aim the bow at a target thereby improving the shooting accuracy of the archer.

It has long been recognized that a bow is a difficult weapon to shoot with consistent accuracy. Many factors can contribute to the inaccuracy of a shot. Such factors as target distance, target size, bow orientation or attitude, arrow speed, arrow weight, wind and visibility all have an effect on accuracy. Since the distance to the target and arrow speed affect the amount of drop the arrow will experience as it travels toward the target, some consider bow orientation to be the most significant of factor influencing accuracy.

In comparison to other weapons, an arrow exhibits a relatively low speed, approximately 175–275+ feet per second. While compound bows and overdraw systems have lessened the amount of vertical drop which will occur as the target distance increases, the effects of gravity must still be taken into account. This is typically done by changing the orientation of the bow and "holding above" the target when aiming the bow.

"Instinct" shooters rely on both their shooting experience and their familiarity with their equipment to compensate for the various accuracy influencing factors. In order to improve the accuracy of the more common archer, numerous types of bow sights have been developed to enable the shooter to consistently hold the bow in the same orientation for a shot of a given distance. One general type of bow sight mounts to the riser of the bow so as to locate one or more sight pins forward of the riser. The sight pins are vertically spaced from one another and are individually set by the archer so that each pin corresponds with a predetermined distance to the target. Preferably, the pins are set at distances which are within the range at which the archer will most typically be shooting.

One problem with the above mentioned type of alignment device is that the sight pins each provide only a single sighting point to be used in connection with aiming of the bow. Obviously, it is possible for the orientation or attitude of the bow to be altered between successive shots at the same distances so that, merely using the same sight pin will not always result in an accurate shot. This realization has lead to the development of what are herein referred to as secondary sights.

Perhaps the most commonly known secondary sight is the bow string mounted "peep" sight. During its use, the peep sight is mounted to the bow string and, once drawn, the shooter looks through the peep sight to align the appropriate sight pin on the target. Although generally considered to be better than a single front sight, these systems also have their disadvantages and limitations.

One limitation is the difficulty with which a peep sight is mounted to the bow string so that it will consistently offer a clear view of the sight pins and the target. Another and often more significant problem is that when looking through the small aperture of the peep sight, the amount of light available to the archer for viewing the sight pin and the target is significantly diminished thereby often drastically inhibiting vision of the target. This is compounded by the fact that the best hunting times are generally considered to occur during the marginal light conditions of dawn and dusk.

A third general variety of bow sight eliminates the peep sight and mounts a supplemental rear sight in combination with the front sight. Rear sights, however, have generally included movable parts, involved complicated aiming techniques or further obstructed visibility of the forward sight and the target itself. As a result, these sights have been impractical for actual hunting situations.

While the above mechanisms are illustrative of some of the sights which have been developed to assist an archer in improving shooting accuracy, they all generally fail to permit adequate sighting during low light shooting conditions. Obviously, there is still a need in the field of this invention for an improved bow sight which can be used to more accurately aim the bow at a target, without complicating the shooting process and without further compromising vision during low light situations of dusk and dawn.

With the above and other limitations in mind, it is a primary object of the present invention to provide a bow sight which can aid an archer in improving shooting consistency and accuracy when using a compound bow, a recurve bow, a long bow or a crossbow.

It is another object of this invention to provide a bow sight which lends itself to use during the low light conditions which are often encountered during hunting.

A further object of the present invention is to provide a bow sight which allows the shooter to easily track a moving target.

Still another object of the present invention is to provide a bow sight having both front and rear sights.

It is also an object of the present invention is to provide a bow sight having multiple front sight pins each of which are intended to be used in combination with a single rear sight "window". The window is configured to permit quick finding of the target, whether moving or stationary, as well as the appropriate sight pin for the estimated target distance.

In achieving the above and other objects, the present invention provides a sighting assembly for a bow. The sighting assembly includes both front and rear sights. The front sight includes a front support bracket which is secured to and extends forward of the frame of the bow. Multiple sight pins are mounted to the front bracket so as to be vertically spaced from one another. Each front sight pin can be adjusted by the archer so that, when used, each pin will generally correspond to a predetermined target distance and will be used when aiming at a target that distance away from the shooter.

The rear sight includes a rear support bracket which extends rearward from the riser and terminates generally adjacent to and in front of the undrawn or relaxed position of the bow string in a recurve or long bow and adjacent to and in front of the cables on a compound bow. A rear sight ring is mounted to the rear support bracket. The rear sight ring defines a relatively large window portion which allows for quick, substantially unobstructed locating of the target through the ring and further includes cross hairs defining and open center area which is aligned with the distal end of the appropriate sight pin and the target. The sight pins, rear window and open area of the cross hairs are all designed to present a minimally obstructed view of one another and the target. In achieving this, low light shooting conditions are not further compromised by the bow sight of the present invention. The present invention also allows for the same sighting technique, the aligning of the open area of the rear cross hairs with one front sight pin and the target to be used for all shooting distances and, once sighted in on a range, no in the field adjustment is typically necessary.

In using the bow sight of the present invention to aim and shoot an arrow at a target, once an arrow is positioned on the bow, nocked, and the bow string drawn back into the shooting position, the archer selects the front sight pin which corresponds with the approximate target distance, and aligns both the front sight pin and the target within the open area of the rear cross hairs. Once aligned, the bow is "on target" and the bow string may be released to project the arrow at the target in an accurate manner.

Additional benefits and advantages of the present invention will become apparent to those skilled in the art to which the present invention relates from the subsequent description of the preferred embodiment and the appended claims, taken in conjunction with the accompanying drawing.

DETAILED DESCRIPTION OF THE PREFERRED EMBODIMENT

Figure 1:
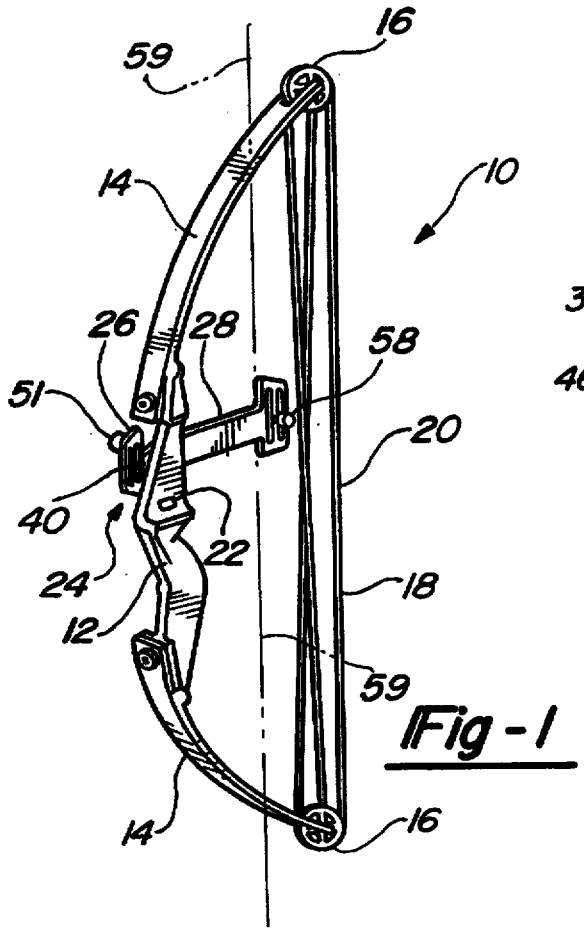
FIG. 1 is a perspective view of a bow having a sight mounted thereto which incorporates the principles of the present invention.
Figure 3:
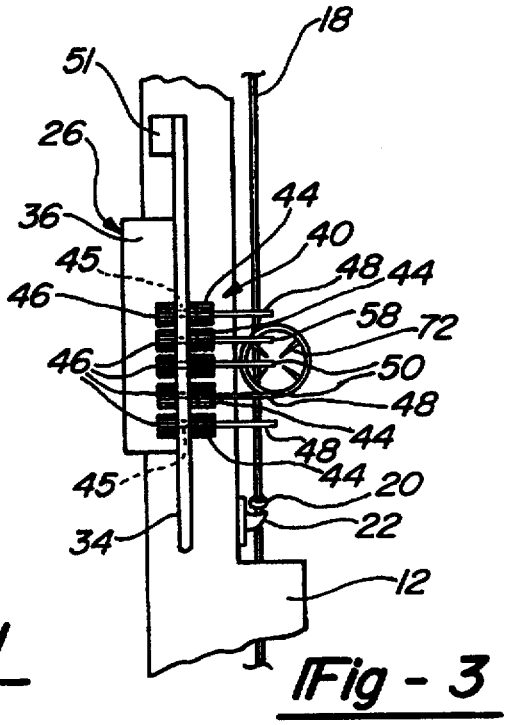
FIG. 3 is front elevational view of a bow sight incorporating the principles of the present invention aimed in the direction of the viewer.

Referring now to the drawing, a compound bow embodying the principles of the present invention is illustrated in FIG. 1 and generally designated at 10. While only a compound bow 10 is illustrated, it will be appreciated that the present invention could also be used with long bows, recurve bows and crossbows. As used herein, the term "bow" is intended to include and encompass all of the above variety of bows.

The bow 10 includes a frame or riser 12 from which extend a pair of cantilevered limbs 14, each having a wheel or pulley 16 mounted at its end. A bow string 18 extends around the wheels 16 and is provided with nocks 20 that allow for an arrow (not shown) to be squarely located on the bow string 18 relative to an arrow rest 22 attached to the riser 12. Mounted on the opposite side of the riser 12 from the arrow rest 22, is a bow sight that is generally designated at 24.

The bow sight 24 principally includes a front sight 26, a rear sight 28 and a mounting plate 30 located therebetween. The mounting plate 30 is secured to the riser 12 by screws or other fasteners (not shown) and preferably, the front and rear sights 26 and 28 are mounted to the mounting bracket 30 so as to permit sliding axial positioning of the front and rear sights 26 and 28 relative to the mounting bracket 30 and the riser 12. While described in greater detail below, one type of mechanism might have the brackets forming the sights 26 and 28 being dovetailed in the mounting bracket 30 and held by set screws (not shown).

As will become evident from the following discussion, it is possible for the front and rear sights 26 and 28 to be separate structures which are individually provided, mounted and adjusted relative to the mounting bracket 30 and the bow. As such, the mounting bracket 30 can be of one of a "universal" variety which permit numerous different bow accessories to be mounted to it. Accordingly, the rear sight 26 itself can be provided for use with a separate front sight 28, such as a conventional sight seen in the prior technology already mounted to the bow 10.

The front sight 26 is a bracket formed with a forward extension portion 32 that positions a mounting plate 34 in a location forward of the riser 12. Since the mounting bracket 30 is located on the outside of the riser 12 and relative to the line of sight and travel of the arrow, the extension portion 32 is bent, approximately 90°, to form an offset 36 between the generally parallel forward extension portion 32 and mounting plate 34.

Figure 2:
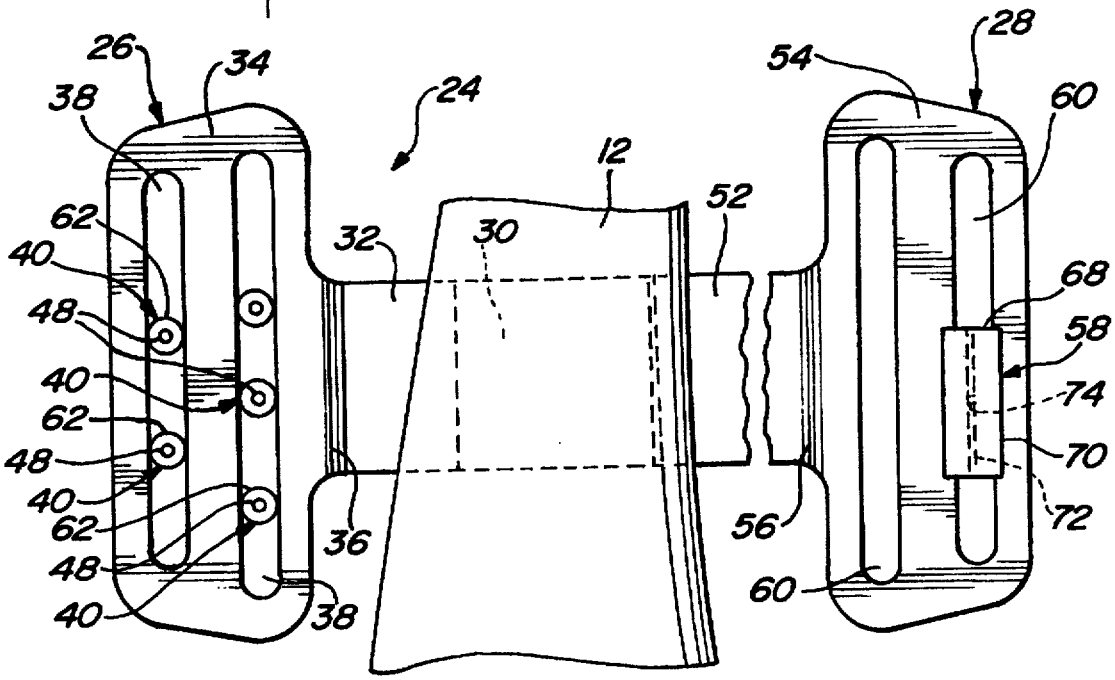
FIG. 2 is an enlarged side elevational view of a bow sight incorporating the principles of the present invention and mounted to the frame of a bow.

One or more adjustment slots 38 are defined in the mounting plate 34 and are positioned in a generally vertical or upright fashion orientation. Multiple sight pins 40, five in the illustrated embodiment, are secured to the mounting plate 34 through the slots 38. The slots 38 permit vertical movement and positioning of the sight pins 40 by the shooter relative to the bow 10 and in this manner each sight pin 40 can be adjusted to correspond with a specific shooting distance. As seen in FIG. 2, vertically adjacent sight pins 40 can be staggered between the two slots 38. This allows each vertically adjacent sight pins 40 to be located more closely together than would otherwise be permitted because of the size of the collars 42 used to secure them to the mounting plate 34. In an alternative construction, the sight pins 40 could be angled with respect to one another so that the distal ends 50 of the pins 40 can be more closely spaced while secured in only one slot 38 in the mounting plate 34.

The collars 42 include a positioning bolt 44 located on one side of the mounting plate 34 and a locking nut 46 located on the opposing side of the mounting plate 34. The positioning bolt 44 includes a threaded shaft 45 (shown in phantom) which extends through the slot 38 and which is engaged by the locking nut 46. To vertically adjust the sight pin 40, the locking nut 46 is loosened from the positioning bolt 44 allowing the sight pin 40 to be vertically moved within the slot 38 to the desired position where the locking nut 46 is re-tightened onto the threaded portion of the positioning bolt 44.

The sight pins 40 each include a pin shaft 48 which extends laterally from the positioning bolt 44 and terminates in a distal end 50 which is used during sighting of the bow 10. The pin shafts 48 are mounted in the positioning bolts 44 to provide for lateral adjustability in the positioning of the distal end 50. As such, the pin shafts 48 may include a threaded proximal end (not shown) which is threadably received within the positioning bolt 44. This lateral adjustability of the pin shafts 48 not only allows for left to right accuracy when aiming the bow 10, but also allows the shooter to compensate for sustained cross winds if desired. Preferably, the pin shafts 48 exhibit a substantially constant diameter and are slender over their lengths. The reasons for this minimalist construction will become more apparent in the discussion which follows.

Additionally, in the preferred embodiment, the sight pins 40 are lighted sight pins which are coupled to a small battery 51 mounted to the mounting bracket 34 which causes the distal ends 50 of the sight pins 40 to illuminate. Ideally, the battery is coupled to a circuit including a photodetector and which is capable of dimming the amount of light being emitted from the distal end 50 of the sight pin 40 as natural light conditions diminish. This prevents "blinding" of the shooter by the sight pin 40 as visibility worsens. An example of another type of pin shaft 48 which could be used with the present invention is constructed from a single strand of monofilament having a thickness sufficient to enable the strand to support itself in a horizontal position. Fifty to one hundred pound test monofilament is believed to be sufficient to withstand the rigors of hunting.

The rear sight 28 includes a bracket having rearward extending portion 52 which positions a rear mounting plate 54 in a location between the riser 12 and the relaxed position of the bow string 18. Similar to the front support bracket 26, the rear mounting plate 54 is laterally spaced from the rearward extending portion 52 by an offset portion or bend 56. A sight ring 58 is secured to the mounting plate 54. Generally, the greater the distance between the front sight pins 40 and the rear sight ring 58 the better. In the present invention, the rear sight 28 locates the sight ring 58 generally between the riser 12 and the relaxed, undrawn position of the bow string 18 of a recurve or long bow and between the riser 12 and the relaxed position of the cables 19 of a compound bow. More preferably, the sight ring 58 is located a distance from the riser 12 which is greater than half the distance (indicated at 59) between the riser 12 and bow string 18 itself. Even more preferably, the sight ring 58 is located adjacent to, within two inches and still more preferably one-half inch of the forwardmost portion of relaxed bow string 18 or cables 19, depending on the specific type of bow.

The sight ring 58 laterally extends from the rear mounting plate 54 and is adjustably secured within a generally vertically defined slot 60 in the rear mounting plate 54. The adjustable mounting of the rear sight 58 is similar to that of the sight pins 40 and accordingly, a collar 61, readily enables for vertical positioning of the rear sight 58 within the slots 60 as well as for laterally adjustability relative to the rear mounting plate 54. The collar 61 includes a positioning bolt 62 located at one side of the rear mounting plate 54 and a locking nut 64 located on the opposing side of the mounting plate 54 which is threadably engaging the positioning bolt 62. A shaft 66 extends from the positioning bolt 62 and is threadably engaged therewith to permit the lateral adjustability of the rear sight 58. Again, once set by the archer on the range, the rear sight 58 need not be adjusted in the field.

As briefly mentioned above, the bow sight 24 is also preferably provided to permit axial adjustment of the rear sight 58 relative to the front sight pins 40. Various mechanisms can be envisioned to permit this axial adjustability. One such mechanism is to provide the rear mounting plate 54 with more than one slot 60. With the slots 60 being axially spaced from one another, they permit the rear sight 58 to be mounted at various axial distances from the sight pins 40. This type of adjustability is illustrated in FIG. 2. Alternatively, and more preferably, the rearward extension 52 of the rear sight 28 is secured to the mounting bracket 30 in a manner which permits axial movement of the rear mounting plate 54 relative to the front sight 26, in effect, moving the axial position of the rear sight ring 58 relative to the front sight pins 40. Again, a dovetail and set screw arrangement would facilitate this type of mounting. Since the actual construction of such a mounting mechanism could take any one of a variety of forms, it is not more specifically described herein.

The sight ring 58 will now be described in greater detail. Secured to the distal end of the shaft 66 is a ring member 68 which defines a large sight window or aperture 70. Extending less than fully across the diameter of the sight window 70 are two pairs of diagonal oriented cross hairs 72. Since each cross hair 72 extends less than completely across the window 70 of the ring 68, the cross hairs 72 cooperate and define an open region 76, generally in the center of the sight window 70.

Figure 5:
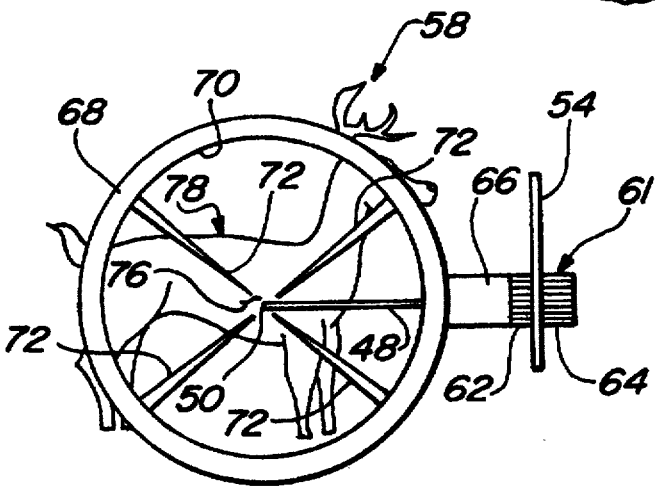
FIG. 5 is an enlarged elevational view through the bow sight of the present invention when aimed at a target.

As seen in FIG. 5, the diameter defined by the sight window 70 is sufficiently large so as to enable the shooter to visualize practically all of the target through the sight window 70. Additionally, the thickness of the sight ring 68 is minimized to allow for peripheral vision of the surroundings of the target and to allow for the easy picking up of a moving target 78. The high visibility of the bow sight 24 is further enhanced by the cross hairs 72 which define open area 76.

The cross hairs 72 themselves define pointers which taper from the ring 68 toward the open area 76 so as to not obstruct vision through the sight window 70 either above, below or to the sides of the target 78. The diagonal positioning of the cross hairs 72 allows for the appropriate pin shaft 48 to be quickly and easily picked up within the sight window 70 by the shooter, since it is not obstructed by a cross hair 72, easily allowing the distal end 50 to be quickly put on target in the open area 76. Also, by substantially seeing the entire length of the pin shaft 48, the illuminated distal end 50 of the sight pin 48 is more readily located within the center of the open area 76. Preferably, the cross hairs 72 are coated with a luminescent paint or material which helps to dimly illuminate the cross hairs 72 in low light conditions without blinding the shooter.

Accordingly, the bow sight of the present invention offers an enhanced aiming system which provides for maximum visibility of a target 78 whether a stationary target or a live target. The increased visibility and aligning system further allow for the maximum entry of light through the rear bow sight 24 to the shooter ensuring good low light condition sighting capabilities while also allowing the shooter to readily pickup movement under these conditions.

Figure 6:
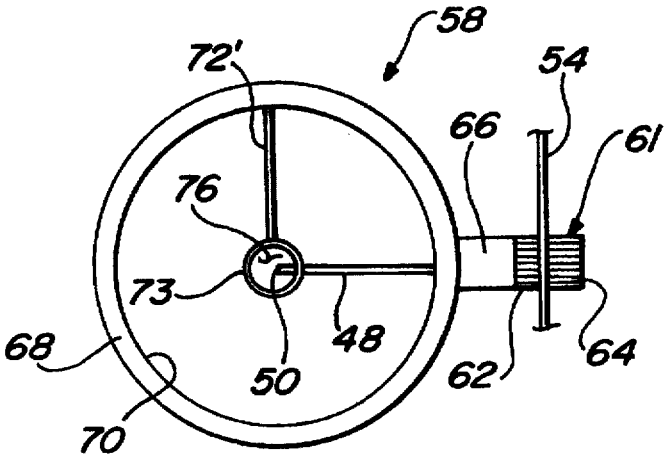
FIG. 6 is an enlarged elevational view of another embodiment of the present invention.

Alternative configurations for the rear sight ring 58 must be such that they do not compromise the enhanced visibility offered by the rear sight 28 in combination with the front sight 26. Obviously, different cross hair 72 patterns could be used without compromising the operability of the present invention. For example, the cross hairs 72 could be oriented horizontally and vertically. This however would partially obstruct shaft 48 of the sight pin 40 then being used to aim at the target 78. Further, an interior ring extending around the cross hairs 72, at a location radially outward from their terminal ends, could be incorporated and sized to operate as a range finder for use in conjunction with the bow sight 24. The number of cross hairs could also be varied with more or less than four being used. For example, the sight window might only incorporate three equally spaced cross hairs 72 extending toward and defining the open area 76. Yet another embodiment is seen in FIG. 6. This embodiment of the invention includes a single downwardly extending crosshair 72' having a dependent ring 73 which defines the open area 76 in which the distal end 50 of the sight pin 40 would be located to orient the bow on target.

Figure 4:
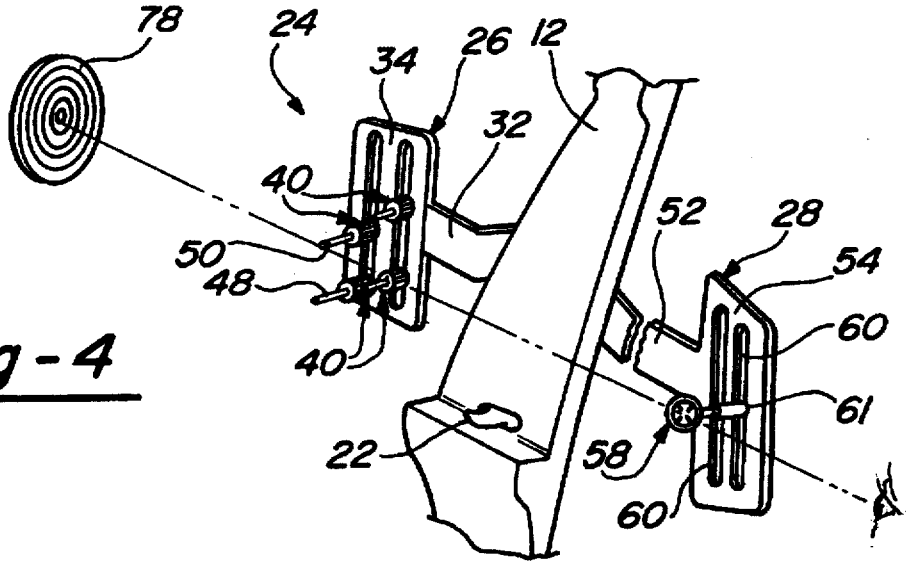
FIG. 4 is a diagrammatic perspective illustration of a bow sight incorporating the principles of the present invention being aimed at a target.

When using the bow sight 24 of the present invention to aim at a target 78, which might be either a stationary target (as in FIG. 4) or wild game (as in FIG. 5), the shooter first estimates the distance from the shooting position to the target 78. The appropriate sight pin 40, corresponding to the target distance, is then selected and the shooter aligns the distal end 50 of that sight pin 40 with the desired impact position of the arrow on the target 78 and positions them centrally within the open area 76 defined between the cross hairs 72. With the bow string 18 drawn and the distal end 50 of the sight pin 40 aligned as described above, the bow string 18 is released to accurately projecting the arrow at the intended target.

While the above description constitutes the preferred embodiment of the present invention, it will be appreciated that the invention is susceptible to modification, variation and change without departing from the proper scope and fair meaning of the accompanying claims.

I claim:

1. A bow sight assembly adapted for mounting to a bow for aiding in the aiming and accurately projecting an arrow from the bow toward a target, the bow including a frame having a bow string extended between ends of the frame, said bow sight assembly comprising:

a front sight including a support bracket mounted to the frame and having an extension portion extending to a location forward of the frame, said extension portion terminating in a front mounting plate having at least one front sight pin mounted thereto, said front sight pin including mounting means for adjustably mounting said front sight pin to said front mounting plate and also including a shaft extending generally laterally away from said mounting bracket and terminating in a distal end; and a rear sight including a support bracket mounted to the frame for axial adjustability with respect thereto and having an extension portion terminating in a mounting plate, said extension portion extending rearward from the frame and positioning said mounting plate in a location between the frame and the bow string, a rear sighting ring secured to said mounting plate and extending generally laterally therefrom, said rear sighting ring including a ring defining a sighting window with portions defining an aperture therethrough, at least one cross hair extending radially inward from said ring and including means for defining an open area generally centrally within said aperture, said open area being alignable with said distal end of said front sight pin and the target to provide for an accurate shot of the arrow from the bow, said cross hair providing substantially unobstructed viewing of the target, said front sight pin and said distal end.

2. A rear bow sight as set forth in claim 1 wherein said sighting ring includes at least one radially inwardly directed cross hair, said cross hair extending less than completely across the diameter of said aperture and terminating so as to define an open center area within said aperture.

3. A rear bow sight as set forth in claim 1 further comprising means for axially adjusting the position of said sighting ring relative to said front sight.

4. A bow sight assembly as set forth in claim 1 wherein at least three cross hairs extend radially inwardly from said ring, said cross hairs terminating extending less than the radius of said aperture and in ends defining said open area.

5. A bow sight assembly as set forth in claim 1 wherein said cross hair is tapered from said ring toward said open area.

6. A bow sight assembly as set forth in claim 1 wherein said sighting ring is adapted for positioning a distance from the bow string which is less than one-half the distance between the bow string and the frame.

7. A bow assembly as set forth in claim 1 wherein said eight pin includes means for illuminating said distal end thereof.

8. A bow assembly as set forth in claim 1 wherein said rear sighting ring includes means for illuminating said rear sighting ring and said cross hairs.

9. A bow sight assembly adapted for mounting to a bow for aiding in the aiming and accurately projecting an arrow from the bow toward a target, the bow including a frame having a bow string extended between ends of the frame, said bow sight assembly comprising:

a front sight including a support bracket mounted to the frame and having an extension portion extending to a location forward of the frame, said extension portion terminating in a front mounting plate having at least one front sight pin mounted thereto, said front sight pin including mounting means for adjustably mounting said front pin sight, said front mounting plate and also including a shaft extending generally laterally away from said mounting bracket and terminating in a distal end; and a rear sight including a support bracket mounted to the frame for axial adjustability with respect thereto and having an extension portion terminating in a mounting plate, said extension portion extending rearward from the frame and positioning said mounting plate in a location between the frame and the bow string, a rear sighting ring secured to said mounting plate and extending generally laterally therefrom, said rear sighting ring including a ring defining a sighting window with portions defining an aperture therethrough, at least three cross hairs extending radially inward from said ring less than the radius of said aperture and terminating in ends defining an open area generally centrally within said aperture, said cross hairs being diagonally oriented and said shaft of said sight pin being viewable between two adjacent cross hairs said open area being alignable with said distal end of said front sight pin and the target to provide for an accurate shot of the arrow from the bow, said cross hair providing substantially unobstructed viewing of the target, said front sight pin and said distal end.

* * * * *

UNITED STATES PATENT AND TRADEMARK OFFICE

CERTIFICATE OF CORRECTION

PATENT NO. : 5,671,724

DATED : September 30, 1997

INVENTOR(S) : Donald F. Priebe

It is certified that error appears in the above-indentified patent and that said Letters Patent is hereby corrected as shown below:

In column 8, line 11, Claim 7, delete "eight" and insert --sight--.

Signed and Sealed this

Sixteenth Day of December, 1997

Bruce Lehman

*Attest:*

BRUCE LEHMAN

*Attesting Officer*

*Commissioner of Patents and Trademarks*